United States Patent [19]

Frey

[11] Patent Number: 4,850,212

[45] Date of Patent: Jul. 25, 1989

[54] BENDING APPARATUS

[76] Inventor: Samuel W. Frey, 18505 County Rd. H., Wauseon, Ohio 43567

[21] Appl. No.: 194,327

[22] Filed: May 13, 1988

[51] Int. Cl.[4] ..... B21D 5/08

[52] U.S. Cl. ..... 72/166; 72/173

[58] Field of Search ..... 72/173–175, 72/170, 166, 177, 248

[56] References Cited

U.S. PATENT DOCUMENTS

| | | | |
|---|---|---|---|
| 1,735,243 | 11/1929 | Hahnemann | 72/175 |
| 2,022,154 | 11/1935 | Rothweiler | 72/174 |
| 2,165,282 | 7/1939 | Loggins | 72/175 |
| 3,724,250 | 4/1973 | Molino | 72/175 |
| 3,899,911 | 8/1975 | Ogier et al. | 72/175 |

FOREIGN PATENT DOCUMENTS

| | | | |
|---|---|---|---|
| 3217 | of 1864 | United Kingdom | 72/173 |
| 5837 | of 1882 | United Kingdom | 72/173 |
| 26250 | of 1912 | United Kingdom | 72/175 |
| 551447 | 2/1943 | United Kingdom | 72/173 |

*Primary Examiner*—Daniel C. Crane
*Attorney, Agent, or Firm*—George R. Royer

[57] ABSTRACT

The subject apparatus is a device constructed and adapted to bend longitudinally extending members into a desired degree of curvature so that such curved members may be used for various architectural or construction purposes. Such apparatus is comprised of a frame member having an upper platform and a lower platform, and disposed between such platform members are a plurality of parallel roller members through which roller members the longitudinal members are drawn and move for the bending process. The roller members are adjustable so as to be positioned relative to another at different positions so as to adjust the degree of curvature finally achieved as the roller members pass therethrough, and for this purpose such rollers are disposed on their respective upper and lower ends in adjustable tracks in the upper and lower platforms respectively so that the rollers can be moved to various distances and positions from one another to accommodate a desired degree of bending.

3 Claims, 3 Drawing Sheets

BENDING APPARATUS

DISCUSSION OF PRIOR ART AND BACKGROUND OF INVENTION

The subject invention pertains to the act of forming longitudinally extending members into curved members through a rolling process consummated by moving the longitudinal extending members through a plurality of juxtaposed rollers, wherein said rollers may be adjusted in the relative position of one to another. Alternately stated, the subject invention is a device employing multiple rollers, adapted to bend pieces of metal or other wire to a predetermined degree of curvature.

There exists in the prior art several types of devices that can form longitudinal members into a curved member of certain desired degree of curvature, however, no such device possesses features that permits effective and flexible adjustment of the rollers to allow for predetermined precision bending operations.

This invention is conceived as a device to overcome the foregoing problems as to produce a roller-based apparatus that is considered to be fully flexible and adaptable for all types of precision bending operations and to accommodate a wide degree of curvature in the bending process and the following objects of the subject invention are directed accordingly.

OBJECTS

It is an object of the subject invention to provide an improved apparatus for consummating the curvature of a straight longitudinal member;

Another object of the subject invention is to provide an improved forming device;

It is another object of the subject invention to provide an improved apparatus for bending longitudinal members;

Another object of the subject invention is to provide an improved roller based forming apparatus;

Still another object of the subject invention is to provide an improved bending device;

Yet another object of the subject invention is to provide an improved forming apparatus;

Still another object of the subject invention is to provide an improved machine based on interaction between rotatable roller members;

Other and further object of the subject invention will become apparent from the reading of the following description taken in conjunction with the drawings and the claims.

DRAWINGS

DESCRIPTION OF GENERAL EMBODIMENT

The subject apparatus is a device constructed and adapted to bend longitudinally extending members into a desired degree of curvature so that such curved members may be used for various architectural or construction purposes. Such apparatus is comprised of a frame member having an upper platform and a lower platform, and disposed between such platform members are a plurality of parallel roller members through which roller members the longitudinal members are drawn and move for the bending process. The roller members are adjustable so as to be positioned relative to another at different positions so as to adjust the degree of curvature finally achieved as the roller members pass therethrough, and for this purpose such rollers are disposed on their respective upper and lower ends in adjustable tracks in the upper and lower platforms respectively so that the roller can be moved to various distances and positions from one another to accommodate a desired degree of bending.

DESCRIPTION OF PREFERRED EMBODIMENT

In describing the preferred embodiment of the subject invention, it is to be noted that the following description shall be of one embodiment only of several that are within the scope of the invention herein, and this description of a particular embodiment shall not be considered as limiting the scope of the invention herein. Moreover, in describing the subject invention, the following nomenclature shall be used. The word "upper" shall refer to those areas above the ground level, while the word "lower" will refer to those areas adjacent or near the ground level as appertaining to a vertically disposed device, as described. The words "longitudinal central axis" will refer to that axis that extends in lengthwise fashion symmetrically through the middle of the object over its length.

Figure 1:
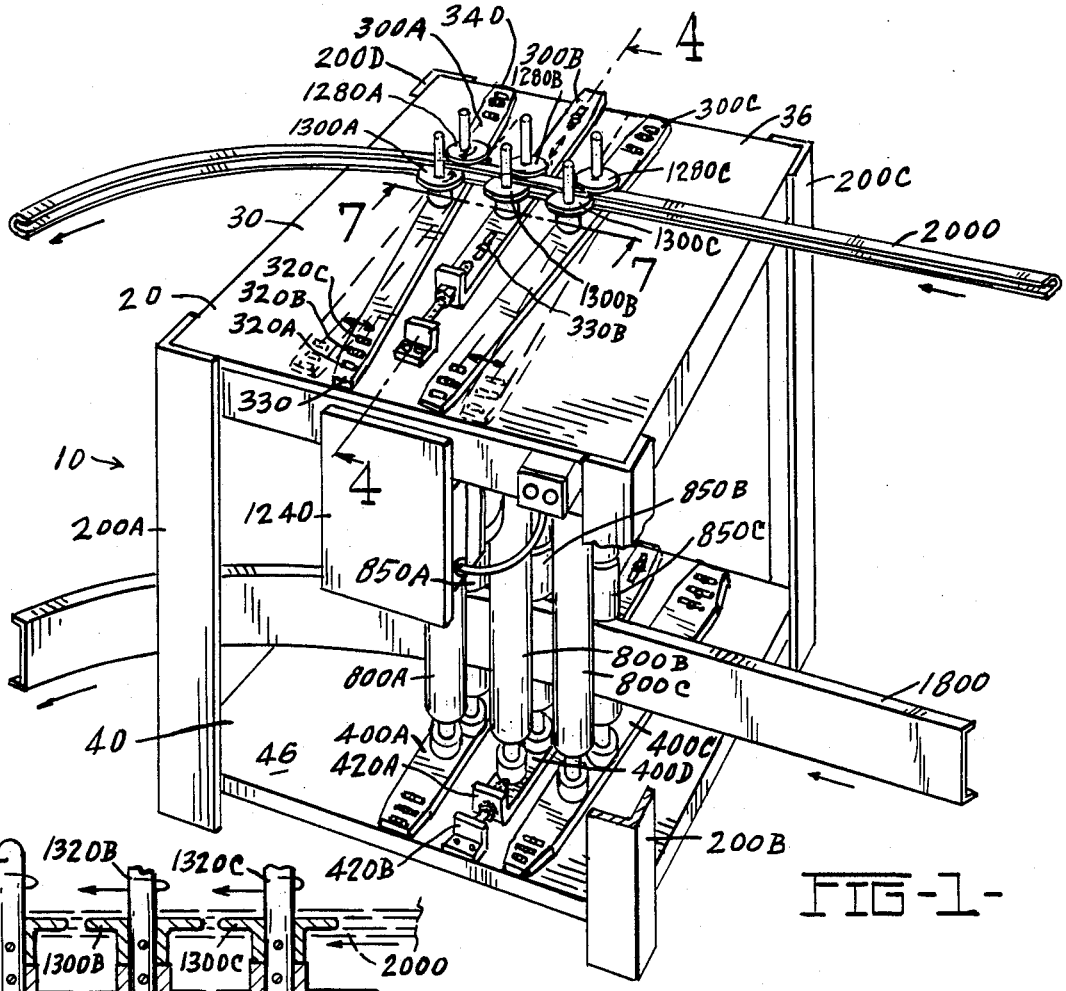
FIG. 1 is a perspective view of the overall apparatus employing the features of the subject invention.

Referring now to the drawings in which a preferred embodiment of the subject invention is shown. In general, the overall machine apparatus 10 that incorporates the subject invention is an upright frame member 20 having an upper platform 30 and a lower platform 40, both of which platforms are preferably, although not essentially, mounted in a horizontal position on such upright frame member 20, with each platform being parallel to one another. The respective upper and lower platforms 30 and 40 are preferably integrally affixed on the upper and lower portions of vertically disposed and free standing support leg members 200A, 200B, 200C and 200D. The leg members 200A, 200B, 200C and 200D can vary in number so long as there are sufficient legs to hold the frame member 20 in the vertically upright position shown in FIGS. 1 and 4. As can be seen from the drawings, both the upper and lower platforms have a plurality of movable roller support members 300A, 300B and 300C and 400A, 400B and 400C, respectively, affixed on the upper surfaces 36 and 46 of the upper platform 30 and lower platform 40, respectively, and as particularly seen in FIG. 1. More particularly, as can be seen in the drawing, and particularly FIGS. 1 and 5 mounted on the upper surface 36 of the upper platform 30 are three longitudinally extending upper roller support members 300A, 300B and 300C. As can be determined from a view of FIG. 1, each upper roller support member 300A, 300B and 300C is generally shaped as a longitudinally extending member having a relative shallow thickness and narrow width. Moreover, as seen, the upper roller support member 300A has a plurality of laterally disposed slot-like openings 320A, 320B and 320C located near the first end 330 thereof and extending completely through the upper roller support member 300A from the upper surface to the lower surface thereof. The second or distal end 340 of the upper roller support member 300A also has a plurality of lateral slots 325A, 325B and 325C disposed therein, and which latter slots are similar in constructional arrangement and positioning to the slots 320A, 320B and 320C on the first end 330 of the upper roller support member 300A. Additionally, upper roller support member 300C has lateral slots disposed in opposing ends of each of such roller support members formed and constructed as in the case of upper roller support member 300A, as shown in FIGS. 1 and 5. On the other hand, intermediate upper roller support member 300B has three longitudinal slots 330A, 330B and 330C on the first end 340A, which are slots that extend parallel to the longitudinal central axis of such upper roller support member 300B or generally perpendicular to the slots in the outboard upper roller support members 300A and 300C. In similar fashion, intermediate roller support member 300B has longitudinal slots 340A, 340B and 340C adjacent the second end 350 of such intermediate upper roller support member 300B.

As can be seen from FIG. 1, the lower roller support members 400A 400B and 400C are constructed in a similar manner and disposition as the upper roller support members and generally have the same slotted openings as do the upper roller support members with two circular openings in the middle, all situated over openings in the lower platform 40, as seen. In effect the shape, size, positioning and arrangement of the lower support members 400A, 400B and 400C are similar and identically located beneath the upper roller support members so that each lower roller support member 400A, 400B and 400C is adapted to be aligned identically and positioned exactly as its mating upper roller support member through suitable adjustments. Thus, as can be seen from the drawings, the middle lower roller support member is adjustable along a limited longitudinal movement as seen in FIG. 1, while the outer support members 400A and 400B are adjustable in a limited lateral movement as seen in FIG. 5, in order to accommodate the specified movements. These movements are identical to the adjustable movements of the upper roller support members 300A, 300B and 300C.

In the constructional arrangement shown in FIG. 1, the upper roller support members 300A, 300B and 300C are positioned on the upper surface and positioned with each such upper roller support member being aligned in a relatively loose but approximate parallel relationship such that the respective longitudinal central axes of the various support members are generally and initially parallel to another, subject to slight modifications away from the mutually parallel relationship as more fully discussed below, and to such positions as shown, for example, in FIG. 5.

The intermediate, middle, upper roller support member 300B is affixed against lateral movement relative to its longitudinal central axis C—C, and is adapted to move back and forth along its axis C—C in a limited longitudinal movement dictated by the length of open slots 330A, 330B, 330C on end 335 and 340A, 340B and on end 345 of such intermediate upper roller support member 340C. As shown in FIG. 1, the movement of intermediate upper roller support member 500B is thus limited to a minimal longitudinal distance over the upper surface of upper platform member 20, as shown, which movement is perpendicular to the movement of direction of the upper roller support members 300A and 300C. Conversely, the upper roller support members 300A and 300C which flank the intermediately disposed upper roller support member 500B, are adapted to move in lateral positions through their respective slot members, as shown in the drawings and particularly FIG. 5. As shown, either end of upper roller support members 300A and 300C can be moved back and forth in such limited lateral movement, as shown, to adjust the relative position of the upper roller support members 300A and 300C relative to the intermediate upper roller support member 300B. As seen in FIG. 5, this lateral movement of the flanking upper roller support members 300A and 300C is shown from a position shown in phantom to a position shown in full off at an angle from the position shown in phantom in FIG. 5.

Integrally disposed in each of the outer upper roller support members 300A and 300B are a pair of circular openings 370A and 370B and 375A and 375B respectively. These circular openings have centers that are aligned along the longitudinal central axis of the respective upper roller support members. Additionally, integrally disposed in the intermediate upper roller support member is a pair of similarly situated circular openings 380A and 380B.

As can be seen in the drawings, the first end 330 and second end 340 of the upper roller support member 300A are aligned over openings 390A, 390B, 390C and 392A, 392B and 392C respectively, disposed on each such end with which openings that preferably extend completely through the upper platform 30. Such openings are adapted to receive a bolt 395A, 395B and 395C, and 396A, 396B and 396C on each such end. These bolts when loosened permit the respective ends 330 and 340 of the upper roller support member 330A to move back and forth in the lateral direction, as shown. Other such bolts or screws 396A . . . 396C are tightened, the upper roller support member is fixed in the intended position, as shown. Additionally, the other outer roller support member 300A is similarly affixed over fixed openings beneath its end slots, and fastened by similar screws or bolts, through its respective end slots. In regard to the longitudinal slots 330A, 300B, 330C and 340A, 340B and 340C in the intermediate upper roller support member 330B, such slots are generally located above similarly situated openings in the upper platform 30, and are appropriate, however, bolt members are provided to lock the intermediate upper roller support member 300B into position.

Figure 4:
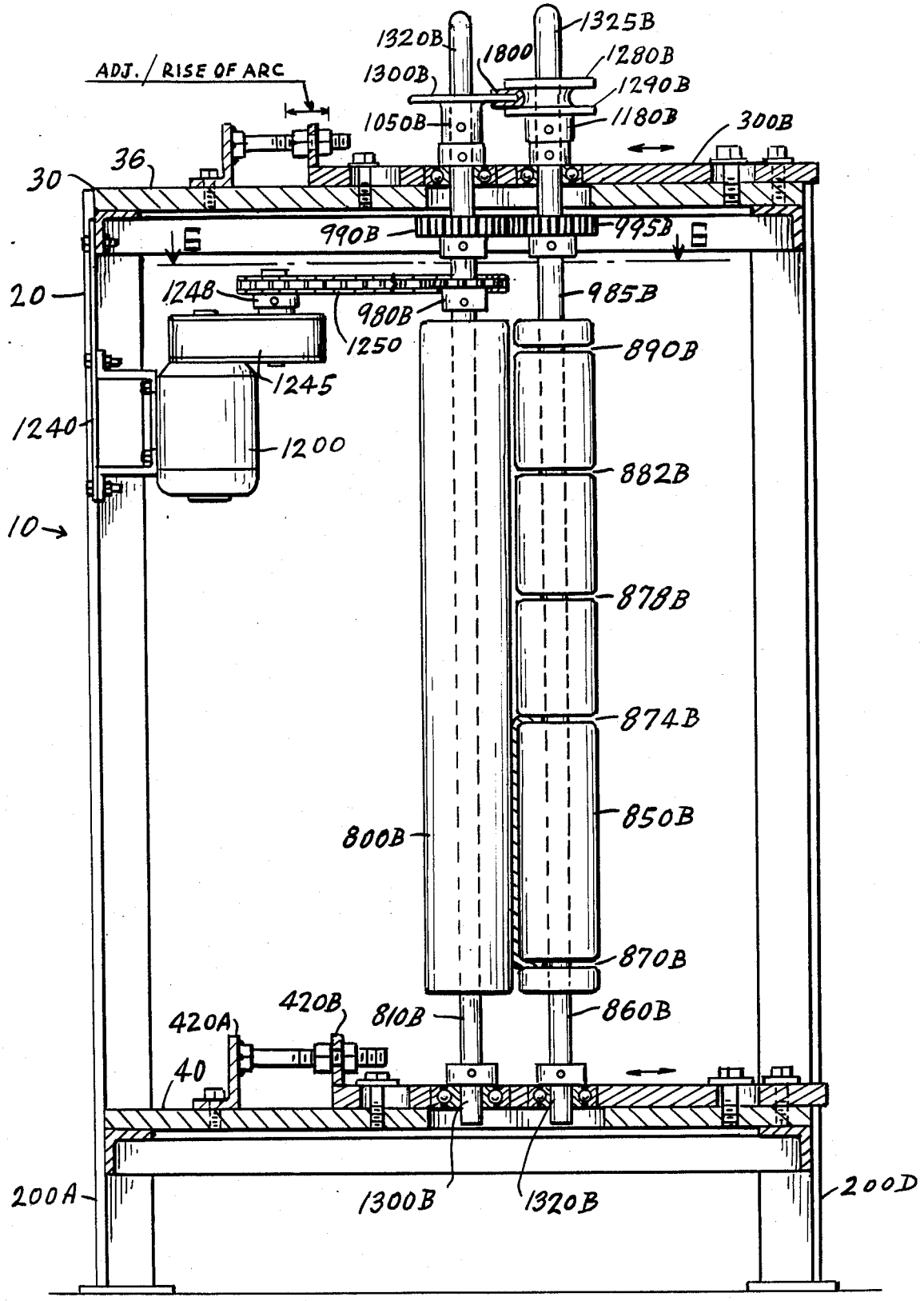
FIG. 4 is a side elevational view in partial cross-section of machine apparatus shown in FIG. 1.
Figure 5:
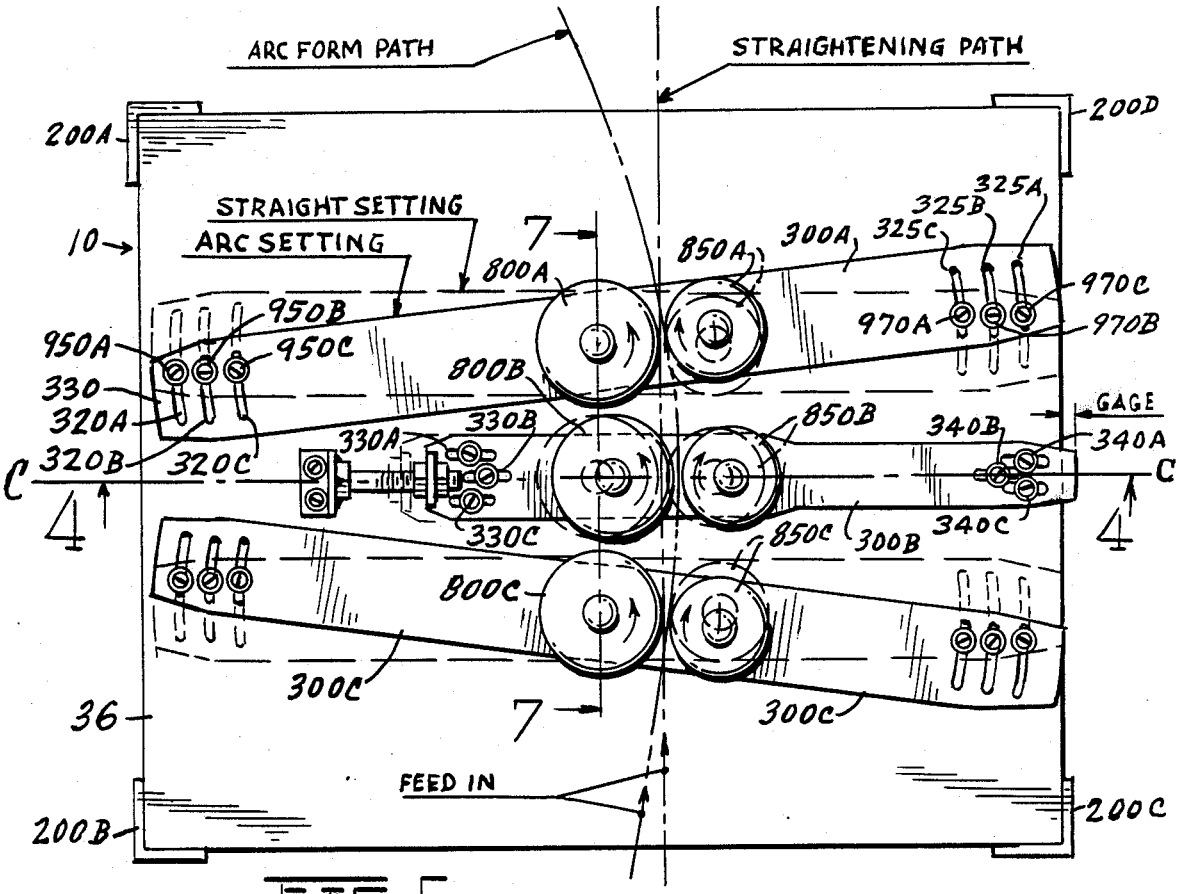
FIG. 5 is a top elevational view of the subject machine apparatus in section, showing the position of the rollers relative to one another in one setting.
Figure 6:
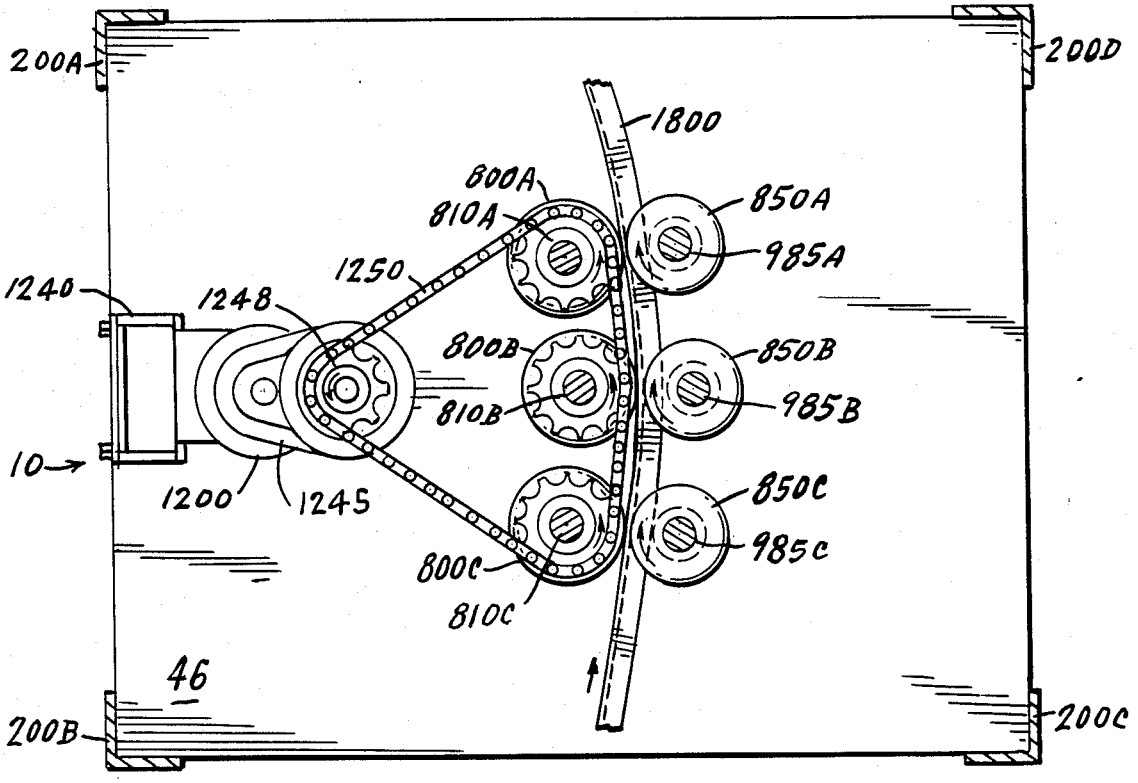
FIG. 6 is a top elevational view in section showing the drive mechanism attached to the roller members.

As shown in FIG. 4 the intermediate upper roller support member is located over a longitudinal opening 398 in the upper platform 30. This latter longitudinal opening is generally situated beneath the two circular openings 380A and 380B in the middle of the intermediate upper roller support members 300A. In similar fashion, the two circular openings 370A and 370B and 375A and 375B respectively in the upper roller support member 300A are also situated over longitudinal opening in platform 300. These functional interrelationships between the openings in platform 30 and the circular openings in the upper roller support members will be more fully discussed below.

As can be seen from the drawings, the upper roller support members 500A and 500C are affixed to the upper surface of the upper platform member through vertically disposed rotatable pin members of cylindrical configuration, wherein such pin members are fixed in position relative to the upper platform. More specifically, as seen in FIG. 5, the upper roller support member 500A is affixed on its first end to pins 950A, 950B and 950C, which latter pins are affixed to the upper surface of upper platform member 30, as shown. Moreover, each of the pins 950A, 950B and 950C while fixed on the upper surface of such upper platform member are inserted through the lateral slots 550A, 550B and 550C in the first end of the upper roller support member. In similar fashion, rotatable pins 970A, 970B and 970C as affixed to the upper surface of the upper platform manner are rotatably inserted through the lateral slots in the second end of the upper roller support member. By this latter arrangement the upper roller support member is movable a limited lateral distance on each of the first end and second end thereof. The upper roller support member 500C is similarly mounted to the upper surface of the upper platform member. From an analysis of the positioning and method of affixation of the upper roller support members 500A and 500C, it can be seen that these two roller support members can be moved laterally on either end thereof and thereby adjustment is made to the angular relationship between the outer upper roller support members 500A and 500C and the intermediate upper roller support member 500B, as schematically shown in the drawings.

Furthermore, as seen in FIG. 5, the middle or intermediate upper roller support member is mounted with rotatable pins being inserted in the longitudinally oriented slots in each end of the intermediate upper roller support member. By this latter arrangement, the intermediate upper roller support member is movable a limited longitudinal distance in either direction, such distance of movement being limited and governed by the length of such slots in the respective ends of such intermediate upper roller support members.

Integrally formed into the approximately middle of each of the upper roller support members 500A, 500B and 500C are mating, opposing circular openings, each of which openings extend completely through the thickness of each of the upper roller support members 500A, 500B and 500C. Such openings are adapted to receive therethrough a portion of a cylindrical roller, as more fully described below.

Formed into the upper surface of the upper platform 30 are a plurality of openings which are adapted to receive the shanks of cylindrical roller members. More particularly, each of such openings extend completely through the upper platform thickness so as to be exposed to both the upper and lower surfaces of such upper platform member.

Moreover, the openings 1100A and 1100B are completely circular and while the intermediate opening 1100B is elongated in a direction which is parallel and preferably aligned along the longitudinal central axis of the intermediate upper roller support member, as shown.

The second set of openings in the upper platform are formed between the respective table-like surfaces. Affixed are vertically disposed rotatable rollers 100A, 100B and 100C which rollers are pivotably mounted for rolling movement. Said rollers are adapted to receive therethrough a longitudinal member to be bent or roller to a desired degree of curvature.

As seen in the drawings, roller 100A is the roller being directly coupled to drive motor 200, as seen in the drawings. For purposes of constructing the preferred embodiment of the subject invention, the motor 200 is integrally affixed in the lower table surface 50. As can be seen in the drawings, the drive motor 200 is adapted to drive vertical roller 100A about a vertical central axis A—A about which such drive roller is adapted to freely rotate and which axis is aligned along the vertically disposed longitudinal central axis of such roller. As can be seen from the drawings, juxtaposed adjacent the drive roller 100A are driven rollers 100B and 100C. Specifically driven rollers 100B and 100C flank the drive roller 100A in a mating tangentially touching position, with rollers 100B and 100C spaced approximately 60° apart relative to the outer circumference of the roller 100A, as seen in the top elevational view of FIG. 3. As can be seen from FIG. 2 and 3 the driven rollers 100B and 100C have a plurality of circumferential indentations extending around the circumference of the roller. As shown in the drawings, the circumferential indentations are spaced apart an arbitrary distance and function to crimp or form the channels or perpendicular edges in the opposing edges of the longitudinal member to be formed.

As can be seen from the drawings, the upper parts of the roller members 100A, 100C and 100D are pivotably and rotatably mounted in the upper table top member for rotation relative to such table top member. In one embodiment of the subject invention, the upper parts 100A, 100B and 110C of rollers 100A, 100C and 100C are formed into reduced diameter portions, of cylindrical shaped constructional configuration. These reduced cylindrical portions are adapted to be inserted into oblong or longitudinal openings in the upper platform 30 and the lower platform 40 through which the upper parts of the rollers can slide back and forth for adjustment purposes, as will be more fully described below.

In the preferred embodiment of the subject invention, the upper parts of the rollers 100A...100C are inserted through the openings in the upper roller support members, as well as the lower parts of the roller being inserted through the openings in the lower roller support members. Thus, as the upper and lower roller support members are moved back and forth to the desired position, as stated above, the rollers are correspondingly repositioned relative to one another so that the longitudinal object to be fed through the rollers will be subjected to a different or variable degree of bending.

As can be seen in the drawings, the non-driven rollers have circumferential indentations therein to accommodate the side portions of a channeled piece such as shown schematically in FIG. 4. Specifically, for example, roller 800A, as shown in FIG. 4, has a series of circumferential indentations 870A, 874B, 878B, 882B and 890B, which can receive a portion of the channel edges to appropriately receive the material to be bent, as shown.

Figure 7:
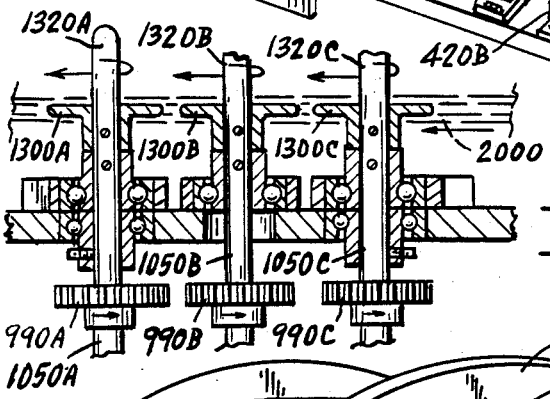
FIG. 7 is a side elevational view of roller setting as assembled in the subject apparatus.
Figure 2:
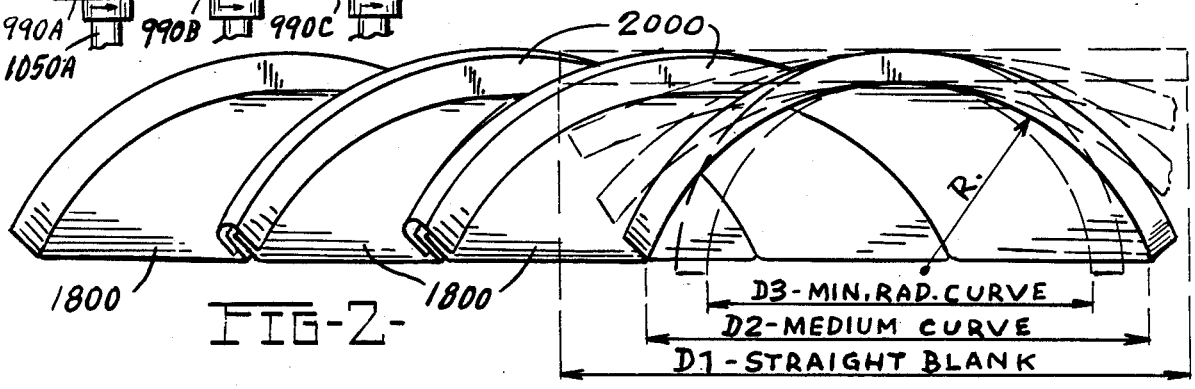
FIG. 2 is a perspective view of various curved members that are produced by the subject apparatus.
Figure 3:
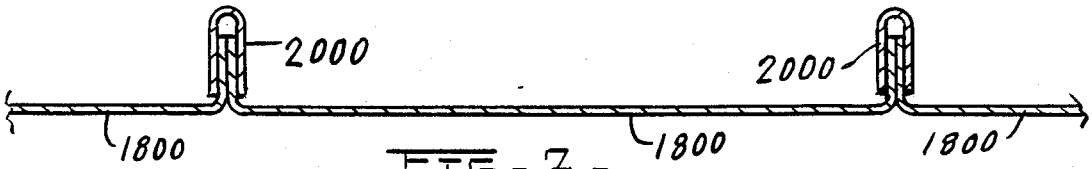
FIG. 3 is a side elevational view of a structure on which the longitudinal members are affixed.

When drive motor 1200 drives belt 1250 which in turn drives drive roller 800B, such latter roller drives driven rollers 800A and 800C, and as such latter two rollers are driven thereby permitting longitudinal members, such as members 2000 shown in FIG. 2 to be moved between the rollers, as shown in FIG. 7, and thereby curved to the desired degree.

In summary, the subject invention is an apparatus adapted to bend or curve longitudinally extending members with a desired predetermined radius comprising a base frame member having an upper platform member and a lower platform member, with both such upper and lower platform members having a plurality of slotted openings therein to receive the ends of vertical roller members completely through the platform member, and a plurality of vertically disposed roller members disposed between such upper and lower platform members at least one of such roller members having circumferential indentations therein, and drive means to drive at least one of such roller members, and adjustment means on the upper and lower platform means to adjust the spacing and angular position between each of the roller members.

Alternately summarized, the subject invention is an apparatus adapted for the bending of longitudinally extending members to a predetermined degree of curvature, such apparatus comprising in combination a base frame member having an upper horizontal platform member of generally flat disposition and a lower horizontal platform member, and wherein such lower platform member is also of flat disposition, and wherein both the upper platform member and the lower platform member have therein a plurality of prepositioned openings extending completely through each of the upper platform member and lower platform member, and wherein such openings in the upper platform are congruently aligned with one another from a vertical perspective, and a plurality of longitudinally extending upper roller support members disposed flush against the upper surface of such upper platform member, and wherein each such upper roller support member has a plurality of openings to receive support means, and a plurality of rotatable roller members disposed between the upper platform member and the lower platform member.

I claim:

1. An apparatus for the bending of longitudinally extending members to a predetermined degree of curvature as the members are fed through the apparatus, such apparatus comprising in combination:

(a) a base frame member having an upper horizontal platform member of generally flat disposition and a lower horizontal platform member, and wherein said lower platform member is also of flat disposition, and wherein both the upper platform member and the lower platform member have therein a plurality of prepositioned openings extending completely through each of the upper platform member and lower platform member, and wherein said respective openings in the upper platform and lower platform member are congruently aligned with one another from a vertical perspective;

(b) a plurality of longitudinally extending upper roller support members disposed flush against the upper surface of said upper platform member, and wherein each said upper roller support member has a plurality of spaced slotted openings therein;

(c) a plurality of rotatable roller members mounted integrally between the upper platform member and the lower platform member and extending through the openings of the upper and lower platform members and rotatably connected to each roller support member;

(d) a plurality of connecting members integrally affixed from the upper portions of each of the roller members to the upper horizontal platform member and wherein each of said connecting members are positioned through one of the pluralities of said slotted openings in each of the upper roller support members, and wherein each of the connecting members has a girth that is less than the outer circumference of each of the slotted openings, whereby each said connecting member can be moved a limited distance in said slot opening.

2. An apparatus adapted to curve, over a longitudinal extent, a longitudinally extending member as the member is fed through the apparatus comprising:

(a) a base support frame member having an upper platform and a lower platform, with both the upper platform and the lower platform having a plurality of slotted openings extending through each of the upper platform and lower platform member, and wherein such slotted openings in each of the upper platform and lower platform members being aligned with another;

(b) a plurality of movable and adjustable longitudinally extending upper roller support members disposed flush against the upper surface of said upper platform member, and wherein each said upper roller support member has a plurality of elongated, slotted openings therein, said openings extending through said upper roller support members, and being vertically and coaxially aligned with the respective openings in the upper platform member;

(c) a plurality of movable and adjustable longitudinally extending lower roller support members disposed flush against the upper surface of said lower platform member, and wherein each said upper roller support member has a plurality of spaced elongated slotted openings therein, said openings extending through said lower roller members, and said openings being vertically and coaxially aligned with the respective openings in the lower platform member;

(d) a plurality of paired rotatable roller members mounted integrally and vertically between the upper platform member and the lower platform member, wherein each of the roller members of the respective pairs of roller members are parallel to one another and tangentially disposed towards one another, and wherein the upper and lower respective ends of the pairs of roller members are rotatably mounted through one of the slotted openings in the upper and lower platform members respectively, and additionally wherein the respective upper and lower ends of such roller members are also rotatably mounted through one of the slotted openings in the upper and lower roller support member respectively:

(e) adjustment and locking means cooperating with each said slotted openings in said support members adapted to move the upper and lower roller support members so as to adjust the relative position of the rollers relative to one another.

3. An apparatus adapted to curve, over a longitudinal extent, a longitudinally extending member as the member is fed through the apparatus comprising:

(a) a base support frame member having an upper platform and a lower platform, with both the upper platform and the lower platform having a plurality of slotted openings extending through each of the upper platform and lower platform member, and wherein such slotted openings in each of the upper platform and lower platform members being aligned with another;

(b) a plurality of movable and adjustable longitudinally extending upper roller support members disposed flush against the upper surface of said upper platform member, and wherein each said upper roller support member has a plurality of spaced elongated, slotted openings therein, said openings extending through said upper roller support members, and being vertically and coaxially aligned with the respective openings in the upper platform member;

(c) a plurality of movable and adjustable longitudinally extending lower roller support members disposed flush against the upper surface of said lower platform member, and wherein each said upper roller support member has a plurality of spaced elongated slotted openings therein, said openings extending through said lower roller members, and said openings being vertically and coaxially aligned with the respective openings in the lower platform member;

(d) three sets of paired rotatable roller members with two sets of such rollers flanking an intermediate set of such rollers mounted integrally and vertically between the upper platform member and the lower platform member, wherein each of the roller members of the respective three pairs of roller members are parallel to one another and tangentially disposed towards one another, and wherein the upper and lower respective ends of the pairs of roller members are rotatably mounted through one of the slotted openings respectively in the upper and lower platform members, and additionally wherein the respective upper and lower ends of such roller members are also rotatably mounted through one of the slotted openings in the upper and lower roller support members respectively, and wherein each of the roller members have circumferential indentations therein to receive edges of the member to be curved;

(e) adjustment and locking means cooperating with each said slotted openings in said support members adapted to move the upper and lower roller support members so as to adjust the relative position of the rollers relative to one another, and specifically having means to move the intermediate set of rollers longitudinally relative to the remaining two sets of rollers, and having means to move the remaining sets of rollers laterally relative to the intermediate set of rollers.

* * * * *